US005182537A

United States Patent [19]

Thuis

[11] Patent Number: 5,182,537

[45] Date of Patent: Jan. 26, 1993

[54] TRANSFORMER WITH TWISTED CONDUCTORS

[75] Inventor: Robbert C. Thuis, Nijmegen, Netherlands

[73] Assignee: U.S. Philips Corporation, New York, N.Y.

[21] Appl. No.: 749,803

[22] Filed: Aug. 26, 1991

[30] Foreign Application Priority Data

Sep. 12, 1990 [NL] Netherlands ..... 9002005

[51] Int. Cl.[5] ..... H01F 27/30

[52] U.S. Cl. ..... 336/180; 336/182

[58] Field of Search ..... 333/127, 177, 180; 336/170, 171, 180, 181, 182, 183, 229

[56] References Cited

U.S. PATENT DOCUMENTS

| | | | |
|---|---|---|---|
| 1,133,750 | 3/1915 | Shaw | 336/170 |
| 1,424,726 | 8/1922 | Johnson | 336/170 |
| 1,559,858 | 11/1925 | Field | 336/170 |
| 3,274,520 | 9/1966 | Eddy et al. | 333/127 |

FOREIGN PATENT DOCUMENTS

| | | | |
|---|---|---|---|
| 60-102709 | 6/1985 | Japan | 336/180 |
| 886071 | 11/1981 | U.S.S.R. | 336/180 |

*Primary Examiner*—Thomas J. Kozma
*Attorney, Agent, or Firm*—Edward Blocker

[57] ABSTRACT

The transformer comprises an annular core (1) of a soft-magnetic material on which there are provided a first winding and a second winding. The second winding comprises n turns more than the first winding. The first winding consisted of a first conductor (3) and a second conductor (5), the second winding consisting of a third conductor (7). The three conductors (3, 5, 7) are twisted over a part of their length so as to form a cable (9) wherefrom a common winding is formed which includes at least a part of the second winding and substantially the entire first winding. Near one end of the common winding there are provided n additional turns of the first conductor (3) and near its other end there are provided n additional turns of the second conductor (5). The corresponding end portions of the first and second conductors (3, 5) are electrically interconnected in order to form terminals (13, 19) of the first winding, and the end portions of the third conductor (7) form terminals (11, 15) of the second winding. Because the n additional turns of the second winding are situated substantially symmetrically with respect to the first winding, the leakage inductance is comparatively low.

4 Claims, 2 Drawing Sheets

TRANSFORMER WITH TWISTED CONDUCTORS

The invention relates to a transformer, comprising an annular core of a soft-magnetic material with a first and a second winding, each of which consists of at least one wire-shaped electrical conductor, which conductors are twisted over at least a part of their length in order to form a cable which is wound around the core, the first winding comprising n turns more than the second winding.

A transformer of this kind is known from NL-A 288,976. The twisting of the conductors aims to minimize the leakage inductance of the transformer and hence render the coupling between the windings as strong as possible. This is generally desirable so as to achieve suitable operation of the transformer. When the number of turns of the first winding is not the same as that of the second winding, as in the case of a transformer of the kind set forth, it is not possible to twist the conductors over their entire length. The n "excess" turns of the first winding are then comparatively weakly coupled to the second winding and the leakage inductance is comparatively high.

It is an object of the invention to provide a transformer of the kind set forth in which the leakage inductance is comparatively low. To achieve this, the transformer in accordance with the invention is characterized in that the first winding consists of a first and a second conductor, the second winding consisting of a third conductor, the three conductors being twisted into a cable over a length which is necessary to form at least a part of the second winding, from the cable there being formed a commonly wound winding which includes said part, near one end of the common winding there being provided n additional turns of the first conductor whilst near the other end of the common winding there are provided n additional turns of the second conductor, the corresponding end portions of the first and the second conductor being electrically interconnected in order to form terminals of the first winding, the end portions of the third conductor forming terminals of the second winding.

The first winding of the transformer in accordance with the invention comprises two parallel-connected conductors which are in principle symmetrically situated with respect to the second winding which consists of a single conductor. As a result, the leakage inductance is substantially lower than in the known transformer. The interconnected, corresponding end portions of the first and the second conductor are preferably twisted.

A preferred embodiment of the transformer in accordance with the invention is characterized in that at least one of the n additional turns of the second conductor has a length which is greater than the circumference of the cross-section of the core and forms a loop which projects radially from the core and which is displaceable in the circumferential direction in order to adjust the leakage inductance. The leakage inductance can be increased or decreased as desired by displacement of the projecting loop, which may be useful for some applications.

This and other aspects of the invention will be described in detail hereinafter with reference to the drawing.

Figure 1:
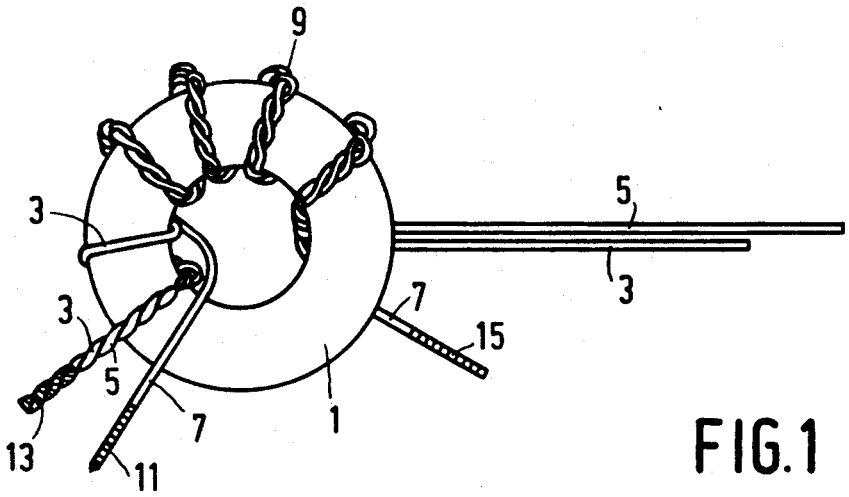
FIGS. 1 to 4 illustrate a number of steps of a method of manufacturing an embodiment of a transformer in accordance with the invention.

FIG. 1 shows an annular core 1 of a soft-magnetic material, for example, ferrite. FIG. 1 also shows a first electrically conductive wire 3, a second electrically conductive wire 5 and a third electrically conductive wire 7. The conductors 3, 5, 7 are, for example, copper wires provided with an electrically insulating jacket. The conductors 3, 5 and 7 are twisted over a part of their length, thus forming a cable 9 which is wound around the core 1. The cable 9 thus forms a common winding which comprises a portion of a first transformer winding and substantially the entire second transformer winding. The conductors 3, 5, 7 are separated near the ends of the cable 9. At the left-hand side in FIG. 1 the left-hand end portion of the third conductor 7 is fed out in order to form a first terminal 11 of the second winding. The left-hand end portion of the second conductor 5 is also fed out and the first conductor 3 is separately wound once more around the core 1 in order to form an additional turn of the first winding, after which the left-hand end portion of the first conductor is twisted together with that of the second conductor 5 in order to form a first terminal 13 of the first winding. At the right-hand side of FIG. 1 the right-hand end portion of the third conductor 7 is fed out in order to form a second terminal 15 of the second winding. The insulating jacket has been removed from the terminals 11, 13, 15 and these terminals are preferably coated with tin. The right-hand end portions of the first and the second conductor 3, 5 are temporarily fed out together.

Figure 2:
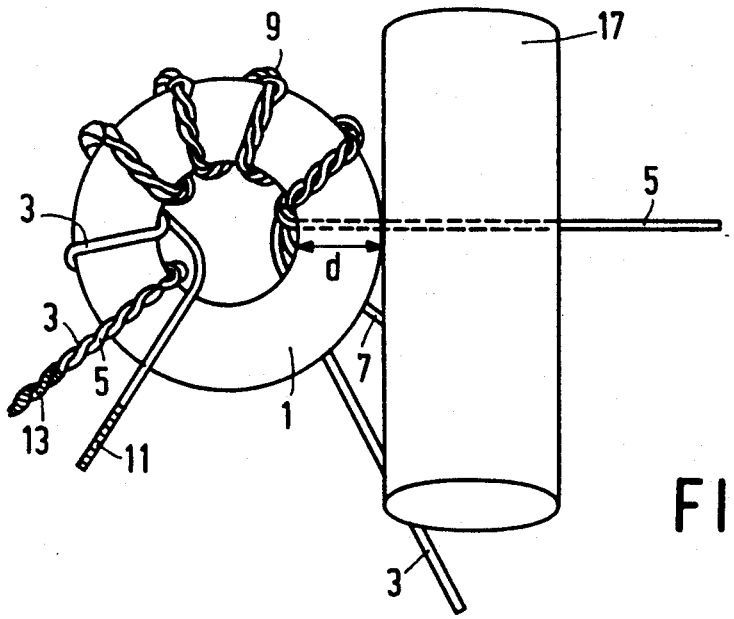
Figure 3:
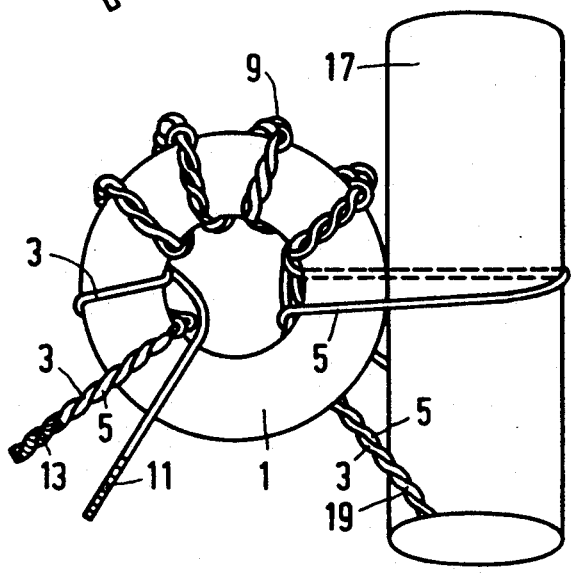
Figure 4:
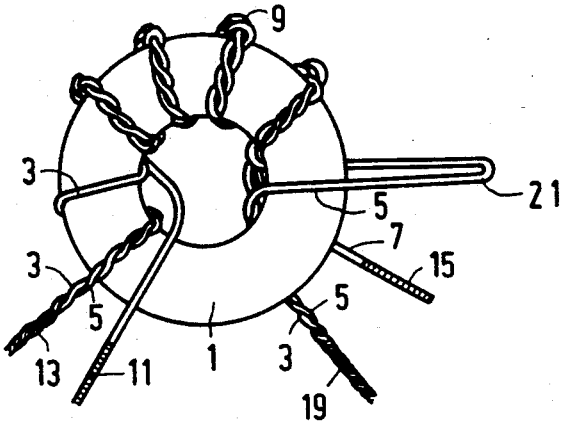

During the step illustrated in FIG. 2 the right-hand end portion of the first conductor 3 is separated from that of the second conductor 5. To the right of the core 1 there is arranged a pin 17 whose diameter amounts to approximately twice the thickness d of the core material in the radial direction. As is shown in FIG. 3, the right-hand end portion of the second conductor 5 is wound once around the core 1 and the pin 17 in order to form an additional turn of the first winding. Subsequently, the right-hand end portions of the first conductor 3 and the second conductor 5 are twisted so as to form a second terminal 19 of the first winding. Finally, as is shown in FIG. 4, the pin 17 is removed and the insulation of the second terminal 19 of the first winding is removed and this terminal is coated with tin, so that the first and second conductors 3, 5 are electrically connected in parallel. The additional turn of the second conductor 5 then forms a loop 21 which radially projects from the core 1 and whose length is substantially greater than the circumference of the cross-section of the core 1. The length of the additional turn of the second conductor 5, therefore, is substantially greater than the length of the additional turn of the first conductor 3 which is approximately equal to the circumference of the cross-section of the core 1.

The first winding of the transformer thus formed comprises four turns formed by the cable 9 and wound in common with the second winding, and one turn formed by the additional turns of the first conductor 3 and the second conductor 5. The twisted end portions of the first and second conductors 3, 5 together form a sixth turn. The second winding comprises the four turns of the cable 9, wound in common with the first winding, and a fifth turn which is formed by the end portions of the third conductor 7. In the described embodiment, therefore, the first winding comprises one turn more than the second winding. Evidently, it is possible to choose the number of additional turns of the first conductor 3 and the second conductor 5 to be greater than one in order to increase the difference n between the numbers of turns of the first and the second winding accordingly.

Because the additional turns are symmetrically situated with respect to the common winding, the leakage inductance caused by these additional turns is comparatively low. This leakage inductance can be varied by means of the loop 21 as will be described in detail hereinafter with reference to FIG. 5. To achieve this, the left-hand end portion of the third conductor 7 is preferably fed out so that it is situated adjacent the right-hand end portion of this conductor. The first terminal 11 of the second winding then extends approximately parallel to the second terminal 15 of this winding. The loop 21 can be displaced in the circumferential direction of the core 1 as denoted by the arrow 23. When the loop 21 is situated near the terminals 11, 15 of the second winding, the additional coupling between the loop 21 and the turn formed by the end portions of the third conductor 7 minimizes the leakage inductance. When the loop 21 is moved to the left according to the arrow 23, this additional coupling continuously decreases so that the leakage inductance continuously increases. The additional coupling is substantially zero (i.e. the leakage inductance is substantially maximum) when the loop 21 is situated approximately diametrically opposite the terminals 11, 15 of the second winding. This position is denoted by broken lines 21'.

Figure 5:
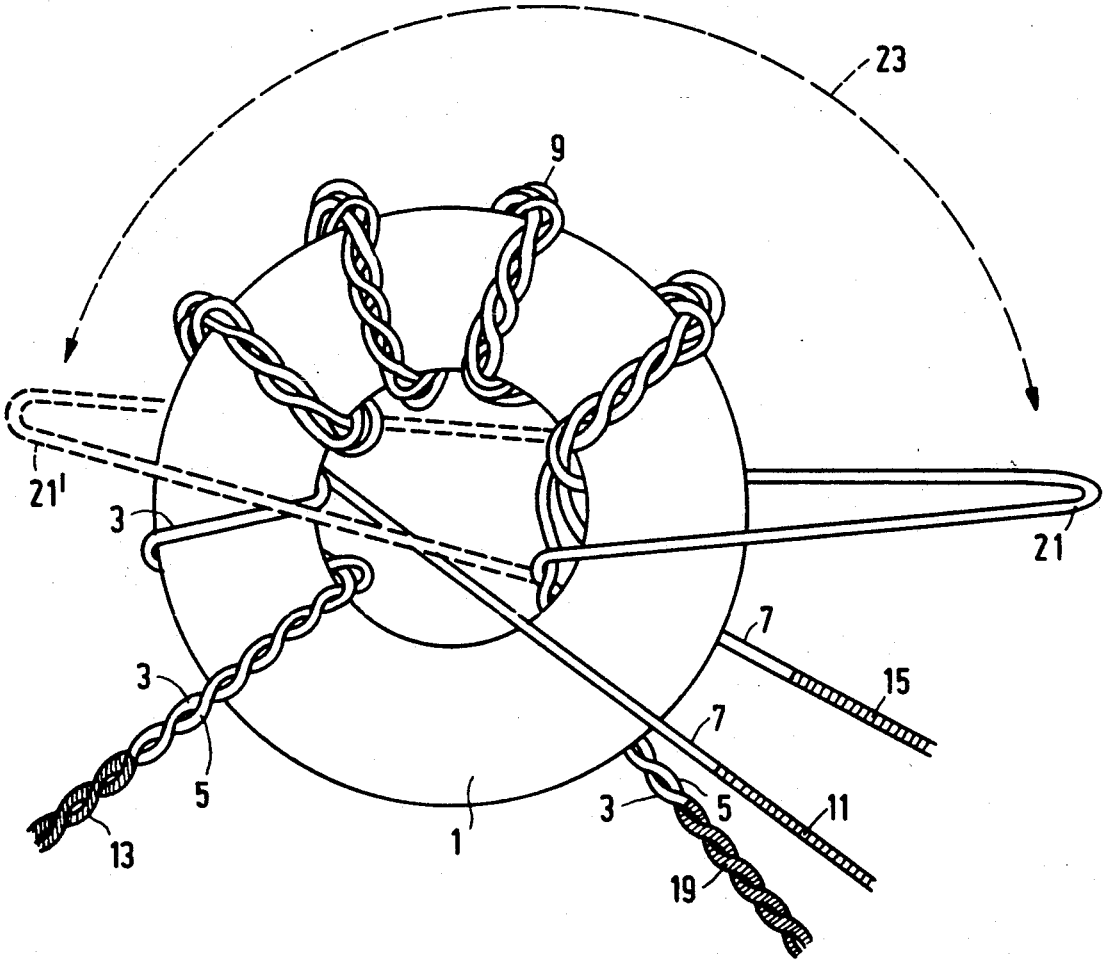
FIG. 5 shows a finished embodiment of a transformer in accordance with the invention.

The adjustability of the leakage inductance described with reference to FIG. 5 is not necessary for all applications of the transformer. In many cases it suffices for the leakage inductance to be as low as possible. In such cases the loop 21, which can be displaced according to the arrow 23 can be dispensed with. The additional turn of the second conductor 5 can then be formed, without utilizing the pin 17, simply by winding the right-hand end portion of this conductor once around the core 1 as is also done with the left-hand end portion of the first conductor 3 in order to form the other additional turn.

If more than one additional turn is required, the number of additional turns of the second conductor 5 which are formed as a loop which is displaceable in the circumferential direction can be chosen as required.

I claim:

1. A transformer, comprising an annular core (1) of a soft-magnetic material with a first and a second winding, each of which consists of at least one wire-shaped electrical conductor (3, 5, 7), which conductors are twisted over at least a part of their length in order to form a cable (9) which is wound around the core (1), the first winding comprising n turns more than the second winding, characterized in that the first winding consists of a first (3) and a second conductor (5), the second winding consisting of a third conductor (7), the three conductors being twisted into a cable (9) over a length which is necessary to form at least a part of the second winding, from the cable there being formed a commonly wound winding which includes said part, near one end of the common winding there being provided n additional turns of the first conductor (3) whilst near the other end of the common winding there are provided n additional turns of the second conductor (5), the corresponding end portions of the first and the second conductor being electrically interconnected in order to form terminals (13, 19) of the first winding, the end portions of the third conductor (7) forming terminals (11, 15) of the second winding.

2. A transformer as claimed in claim 1, characterized in that the interconnected, corresponding end portions of the first conductor (3) and the second conductor (5) are twisted.

3. A transformer as claimed in claim 1, characterized in that at least one of the n additional turns of the second conductor (5) has a length which is greater than the circumference of the cross-section of the core (1) and forms a loop (21) which projects radially from the core and which is displaceable in the circumferential direction in order to adjust the leakage inductance.

4. A transformer as claimed in claim 2, characterized in that at least one of the n additional turns of the second conductor (5) has a length which is greater than the circumference of the cross-section of the core (1) and forms a loop (21) which projects radially from the core and which is displaceable in the circumferential direction in order to adjust the leakage inductance.

* * * * *